US011040540B2

(12) United States Patent
Baterna et al.

(10) Patent No.: US 11,040,540 B2
(45) **Date of Patent: *Jun. 22, 2021**

(54) DUAL SPITTOON ARRANGEMENT FOR INKJET PRINTHEAD

(71) Applicant: MEMJET TECHNOLOGY LIMITED, Dublin (IE)

(72) Inventors: Dan Baterna, North Ryde (AU); Rommel Balala, North Ryde (AU)

(73) Assignee: Memjet Technology Limited

( * ) Notice: Subject to any disclaimer, the term of this patent is extended or adjusted under 35 U.S.C. 154(b) by 0 days.

This patent is subject to a terminal disclaimer.

(21) Appl. No.: 16/864,913

(22) Filed: May 1, 2020

(65) Prior Publication Data

US 2020/0254763 A1 Aug. 13, 2020

Related U.S. Application Data

(63) Continuation of application No. 16/184,133, filed on Nov. 8, 2018, now Pat. No. 10,675,872, which is a continuation-in-part of application No. 15/977,986, filed on May 11, 2018, now Pat. No. 10,525,712.

(60) Provisional application No. 62/583,349, filed on Nov. 8, 2017, provisional application No. 62/505,736, filed on May 12, 2017, provisional application No. 62/527,929, filed on Jun. 30, 2017.

(51) Int. Cl.
*B41J 2/165* (2006.01)
*B41J 11/02* (2006.01)

(52) U.S. Cl.
CPC ..... *B41J 2/16523* (2013.01); *B41J 2/16505* (2013.01); *B41J 2/16508* (2013.01); *B41J 2/16526* (2013.01); *B41J 2/16535* (2013.01); *B41J 2/16538* (2013.01); *B41J 2/16547* (2013.01); *B41J 11/02* (2013.01)

(58) Field of Classification Search
CPC ..... B41J 2/16523; B41J 2/16526; B41J 2/16508; B41J 11/02; B41J 2/16547; B41J 2/16538; B41J 2/16535; B41J 2/16505
USPC ..... 347/34
See application file for complete search history.

*Primary Examiner* — Huan H Tran
*Assistant Examiner* — Alexander D Shenderov
(74) *Attorney, Agent, or Firm* — Cooley LLP

(57) ABSTRACT

A printer includes: an inkjet printhead having first and second rows of printhead chips; a platen having first and second spittoon slots corresponding to the first and second rows of printhead chips, each spittoon slot having a length corresponding to a length of the printhead and a width extending between a respective upstream sidewall and a respective downstream sidewall of the platen; first and second rollers positioned in the respective first and second spittoon slots for receiving ink spitted from the first and second rows of printhead chips; a rotation mechanism for rotating the first and second rollers; and first and second scrapers engaged with respective first and second rollers. A diameter of each roller is less than the width of its respective spittoon slot.

19 Claims, 4 Drawing Sheets

DUAL SPITTOON ARRANGEMENT FOR INKJET PRINTHEAD

CROSS-REFERENCE TO RELATED APPLICATIONS

The present application is a continuation of U.S. application Ser. No. 16/184,133 filed Nov. 8, 2018, which claims the benefit of priority under 35 U.S.C. § 119(e) of U.S. Provisional Application No. 62/583,349, entitled SPITTOON FOR INKJET PRINTHEAD, filed Nov. 8, 2017 and which is a continuation-in-part of U.S. application Ser. No. 15/977,986, entitled MIST EXTRACTION SYSTEM FOR INKJET PRINTHEAD, filed May 11, 2018, which claims the benefit of priority under 35 U.S.C. § 119(e) of U.S. Provisional Application No. 62/505,736, entitled MIST EXTRACTION SYSTEM FOR INKJET PRINTHEAD, filed May 12, 2017 and of U.S. Provisional Application No. 62/527,929, entitled PARTICLE COLLECTION SYSTEM FOR AN INKJET PRINTER, filed Jun. 30, 2017, the contents of each of which are hereby incorporated by reference in their entirety for all purposes.

FIELD OF THE INVENTION

This invention relates to a spittoon system for an inkjet printhead. It has been developed primarily for collecting spitted ink from a printhead as well as collecting ink aerosol from a print zone associated with the printhead.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

Sheet-fed pagewide printers typically spit ink between pages (as well as on the page) in order to ensure inkjet nozzles are healthy and remain hydrated with ink. Without inter-page spitting nozzles are at risk of dehydration and may require additional maintenance interventions, such as wiping or pressure-purging. Therefore, sheet-fed printers typically have a platen equipped with a spittoon for receiving spitted ink when the printhead is not printing onto a page. For example, US2011/0279538, the contents of which are incorporated herein by reference, describes a platen having a gap between upstream and downstream ribs with an absorbent spittoon material disposed in the gap below the ribs. U.S. Provisional Application No. 62/505,736 filed 12 May 2017, the contents of which are incorporated herein by reference, describes a platen having a wick bar configured for managing ink aerosol and handling paper dust generated during high-speed printing.

Pigment-based ink presents unique challenges for ink collection compared to dye-based inks. Whereas dye-based inks may be collected on an absorbent material with dyes remaining solubilized in the aqueous medium, pigment-based ink are less amenable to collection on absorbent materials since the insoluble pigment tends precipitate from the ink and clog the material, thereby reducing the material's wicking capabilities.

U.S. Pat. No. 8,091,978 (assigned to HP Inc.) describes a spittoon arrangement suitable for collecting pigment-based inks. In this arrangement, rollers having non-absorbent surfaces are positioned beneath staggered slots in a platen and ink is scraped from the rollers for removal.

It would be desirable to provide an improved spittoon for an inkjet printhead suitable for collecting pigment-based ink spitted from the printhead. It would further be desirable to provide a spittoon which manages airflow for aerosol collection as well as collecting the spitted ink.

SUMMARY OF THE INVENTION

In a first aspect, there is provided a printer comprising:

an inkjet printhead having at least one row of printhead chips;

a platen having at least one spittoon slot, the spittoon slot having a length corresponding to a length of the printhead and a width extending between an upstream sidewall and a downstream sidewall of the platen;

a roller positioned in the spittoon slot between the upstream and downstream sidewalls for receiving ink spitted from the printhead, a rotation mechanism for rotating the roller; and a scraper engaged with the roller, wherein:

a diameter of the roller is less than the width of the spittoon slot; and an upper roller surface is relatively closer to the printhead than an upper surface of at least one of the upstream sidewall and the downstream sidewall.

Preferably, an upper surface of the roller is less than 3 mm, less than 2.5 mm or less than 2 mm from a nozzle plate of the printhead. Proximal positioning of the roller relative to the printhead assists in collection of spitted ink and, furthermore, assists in directing airflow and ink aerosol into the spittoon slot via gap(s) at the side of the roller.

In some embodiments, the spittoon slot is under suction. In other embodiments, no external suction is applied to the spittoon slot.

Preferably, a longitudinal axis of the roller is offset from the row of printhead chips.

Preferably, a centerline of the row of printhead chips is downstream of the longitudinal axis of the roller relative to the media feed direction.

Preferably, the rotation mechanism is configured to rotate the roller such that an upper surface of the roller moves in a same direction as the media feed direction.

Preferably, an upstream gap and a downstream gap are defined at either side of the roller and, more preferably, rotation of the roller directs ink aerosol into the downstream gap by virtue of a proximity of the roller to the platen surface.

Preferably, the upstream gap is wider than the downstream gap or vice versa.

Preferably, the platen comprises a plurality of spaced apart ribs projecting upwards from a platen surface for supporting print media clear of the roller.

Preferably, the printhead comprises first and second rows of printhead chips and the platen has first and second spittoon slots corresponding to the first and second rows of printhead chips, and more preferably, a first roller is positioned in the first spittoon slot and a second roller is positioned in the second spittoon slot.

Preferably, each of the first and second rows of printhead chips comprises a continuous line of butting printhead chips and each of the first and second spittoon slots has sufficient length to receive ink from respective first and second rows of printhead chips.

Preferably, the platen comprises a dividing wall positioned between the first and second rows of printhead chips, the dividing wall defining a downstream sidewall for the first spittoon slot and an upstream sidewall for the second spittoon slot.

Preferably, a plurality of intermediate ribs project upwardly from the dividing wall for supporting print media between the first and second spittoon slots.

Preferably, each intermediate rib has an upwardly flared profile.

Preferably, an upper surface of each intermediate rib is angled upwards towards a downstream side thereof.

Preferably, the platen further comprises upstream ribs projecting upwardly from the upstream sidewall at the upstream side of the first spittoon slot and downstream ribs projecting upwardly from the downstream sidewall at the downstream side of the second spittoon slot.

Preferably, the upstream ribs, the downstream ribs and the intermediate ribs are all offset from each on the media feed direction.

Preferably, the rotation mechanism is configured to rotate the first and second rollers in a same direction such that an upper surface of each roller moves in a same direction as the media feed direction.

Preferably, the platen further comprises a removable collection tray positioned beneath the first and second spittoon slots.

Preferably, the collection tray receives ink from respective scrapers under gravity.

Preferably, the ink is an aqueous pigment-based ink.

As used herein, the term "printer" refers to any printing device for marking print media, such as conventional desktop printers, label printers, duplicators, copiers and the like. In one embodiment, the printer is a sheet-fed printing device.

As used herein, the term "ink" refers to any printable fluid, including conventional dye-based and pigment-based inks, infrared inks, UV curable inks, 3D printing fluids, biological fluids, colorless ink vehicles etc.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
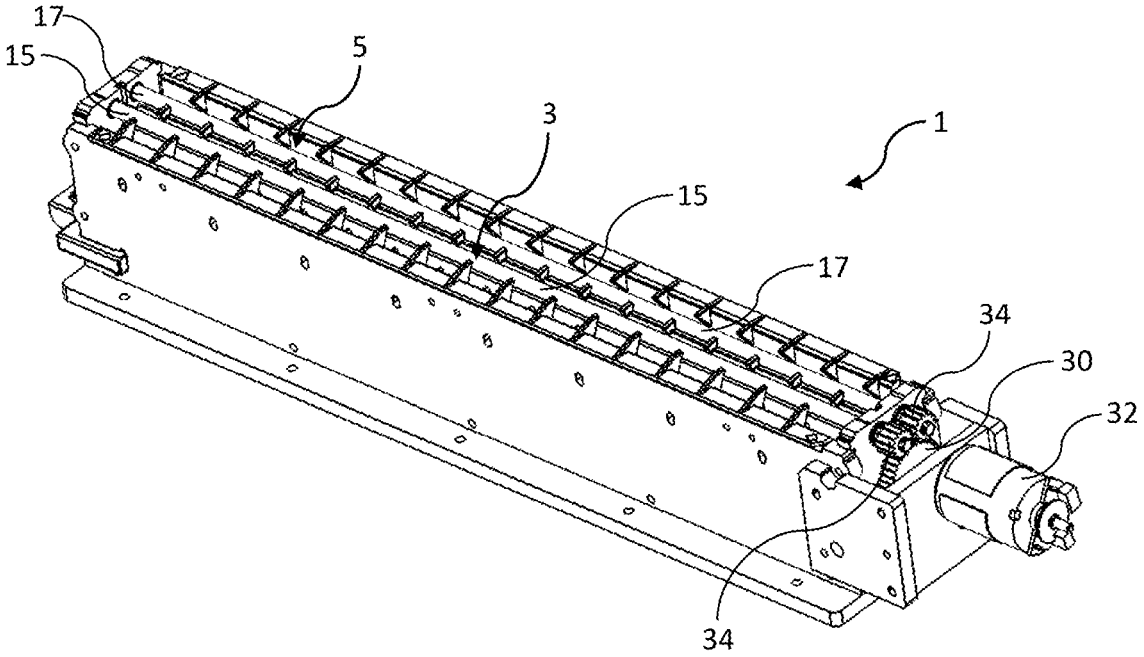
FIG. 1 is a perspective view of a platen incorporating a spittoon.
Figure 2:
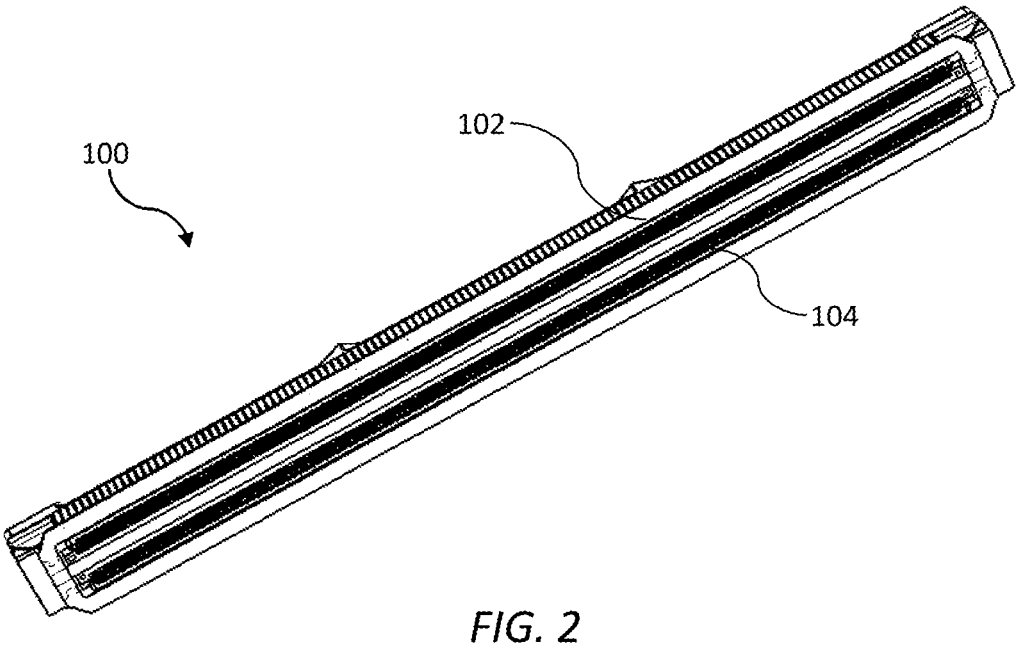
FIG. 2 is a bottom perspective of a printhead having two rows of butting printhead chips.
Figure 3:
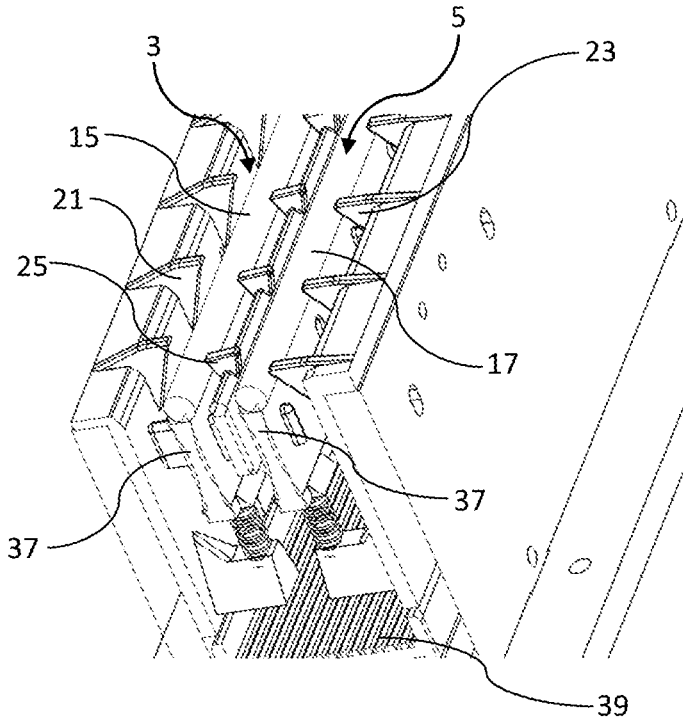
FIG. 3 is a sectional perspective of the platen shown in FIG. 1.
Figure 4:
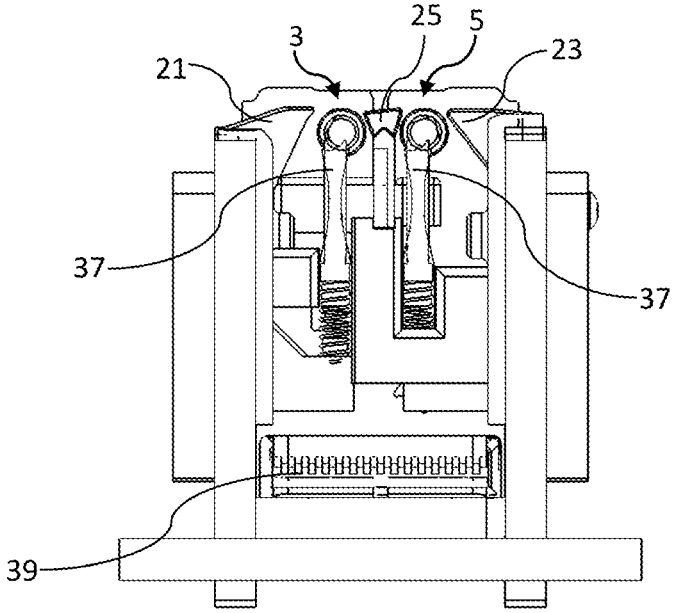
FIG. 4 is a sectional view of the platen shown in FIG. 1.
Figure 5:
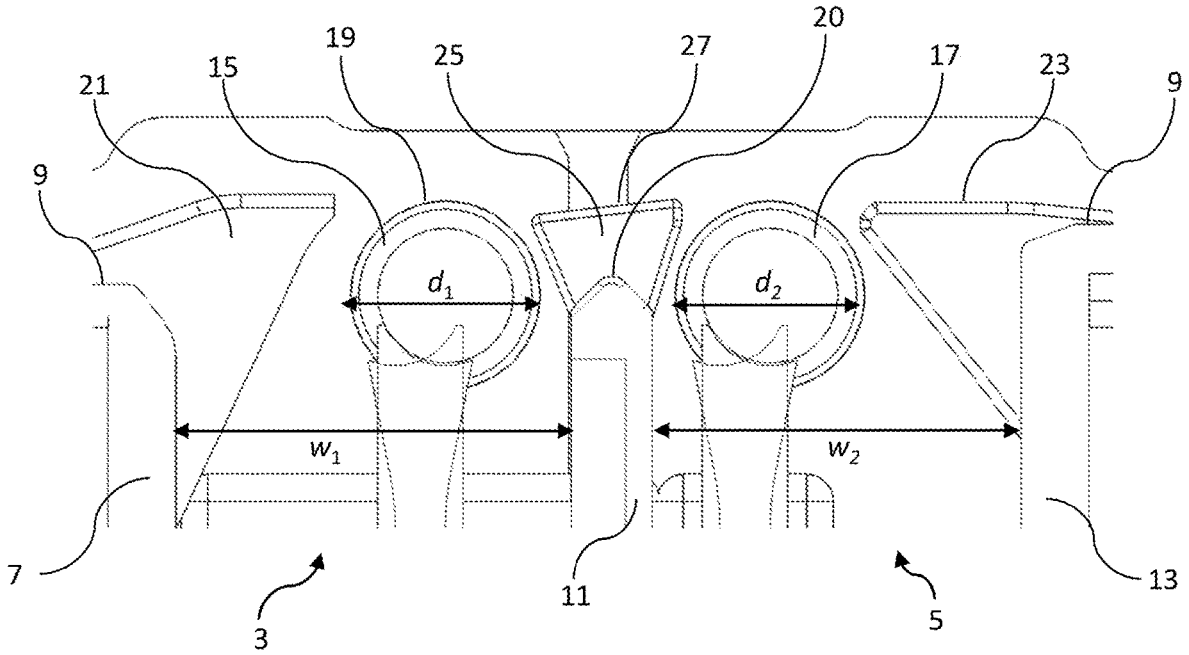
FIG. 5 is a sectional view of first and second spittoon slots having respective first and second rollers.
Figure 6:
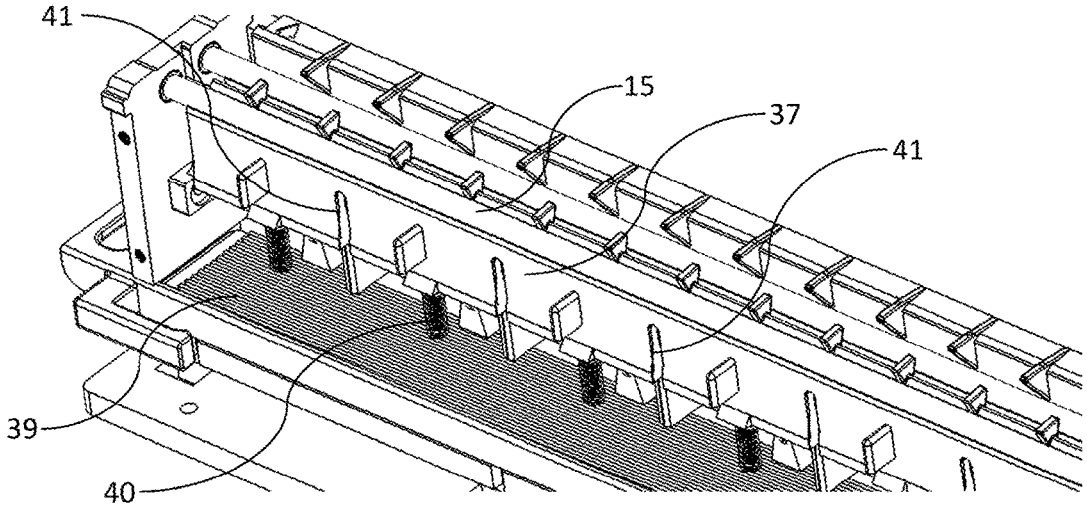
FIG. 6 is a cutaway perspective of the platen shown in FIG. 1.

Referring to FIGS. 1 to 7, there is shown a platen 1 suitable for use with a printhead 100 having first and second rows of butting printhead chips 102 and 104. An example of such a printhead 100 is shown in FIG. 2 and described in further detail in U.S. Provisional Application No. 62/455,346 filed on 6 Feb. 2017, the contents of which are incorporated herein by reference.

The platen 1 incorporates a spittoon having first and second spittoon slots 3 and 5, which extend continuously along a length of the platen so as to be at least as long as respective first and second rows of printhead chips 102 and 104. The first spittoon slot 3 is defined between an upstream sidewall 7 extending downwardly from a platen surface 9 and a dividing wall 11. The second spittoon slot 5 is downstream of the first spittoon slot 3 relative to a media feed direction at an opposite side of the dividing wall 11. In particular, the second spittoon slot 5 is defined between the dividing wall 11 and a downstream sidewall 13 extending downwardly from the platen surface 9. In other words, the dividing wall defines a downstream sidewall for the first spittoon slot 3 and an upstream sidewall for the second spittoon slot 5.

A first roller 15 is positioned in the first spittoon slot 3 between the upstream sidewall 7 and the dividing wall 11, and a second roller 17 is positioned in the second spittoon slot between the dividing wall 11 and the downstream sidewall 13. The first roller 15 has a diameter $d_1$, which is less than a width $w_1$ of the first spittoon slot 3. Likewise, the second roller 17 has a diameter $d_2$, which is less than a width $w_2$ of the second spittoon slot 5. Further, each of the first and second rollers 15 and 17 has a respective upper roller surface 19, which is relatively higher than an upper surface 20 of the dividing wall 11 such that the roller surface is proximal a nozzle plate of the printhead 100.

A plurality of upstream ribs 21 project upwardly from an upper part of the upstream sidewall and are spaced apart along its length. Similarly, a plurality of downstream ribs 23 project upwardly from an upper part of the downstream sidewall and are spaced apart along its length. Intermediate ribs 25 project upwardly from an upper part of the dividing wall 11 so that the upstream ribs 21, the downstream ribs 23 and the intermediate ribs together provide support for print media as it crosses over the first spittoon slot 3 and then over the second spittoon slot 5 during printing. The upstream ribs 21, the downstream ribs 23 and the intermediate ribs are all offset from the each in the media feed direction to avoid any paper dust (which may be mixed with ink) concentrating on one portion of the print media.

Each intermediate rib 25 has a flared profile such that an intermediate rib surface 27 is relatively wider than the dividing wall 11. The intermediate ribs 25 are therefore configured to accommodate the first and second rollers 15 and 17 in close proximity at either side thereof. In addition, the intermediate rib surface 27 is angled upwards towards the downstream slot 5 so as to direct print media away from the second roller 17 and minimize underside fouling of print media by the second roller.

Each of the first and second rollers 15 and 17 is operatively connected to a rotation mechanism in the form of a main drive gear 30 connected to a drive motor 32. Engagement of respective roller gear wheels 34 with the main drive gear 30 rotates the first and second rollers 15 and 17 in a same rotational direction.

The first and second rollers 15 and 17 have non-absorbent surfaces for receiving spitted ink and/or paper dust. The ink and/or paper dust is scraped from each roller during rotation by means of a respective scraper 37. Each scraper 37 is flexible and resiliently engaged with its respective roller so as to direct scraped ink under gravity towards a removable collection tray 39 positioned beneath the rollers. Springs 40 provide resilient biasing of the scrapers 37 towards respective rollers, while vertical notches 41 spaced apart along a length of each scraper minimize the engagement force between the scrapers and the rollers.

Figure 7:
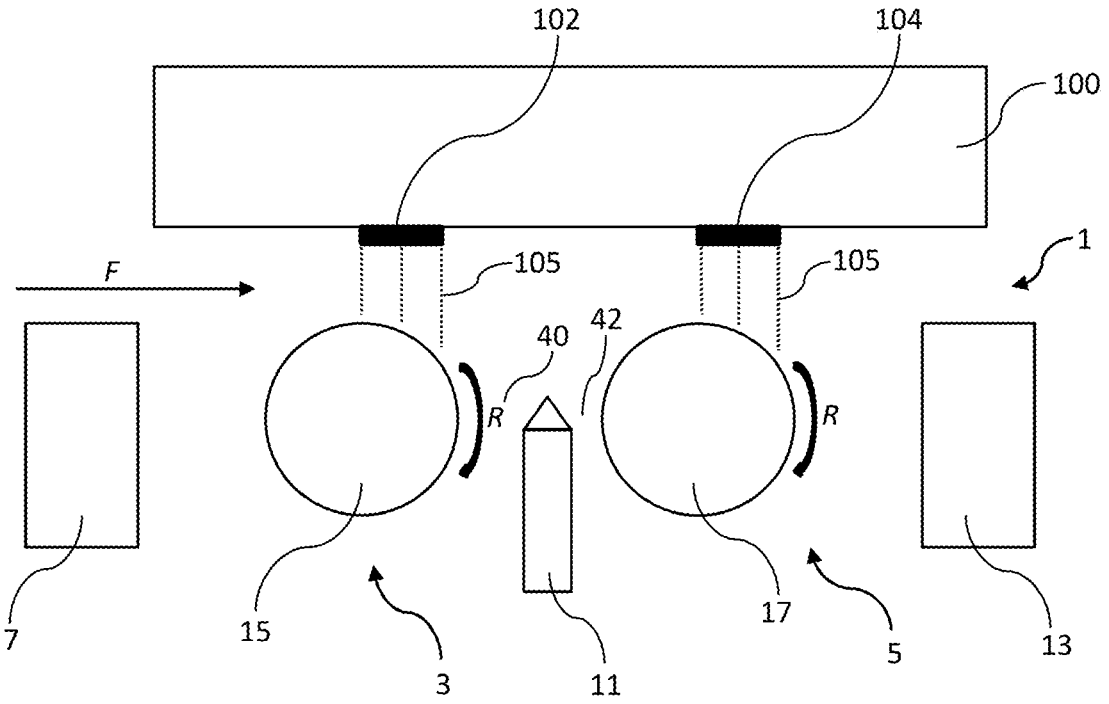
FIG. 7 is a schematic view of a printer comprising a printhead and a platen according to one embodiment of the present invention.

Referring to FIG. 7, in use, the platen 1 is positioned below the printhead 100 while sheets of print media are fed past the printhead in a media feed direction indicated by arrow F.

The first and second rollers 15 and 17 and respective first and second spittoon slots 3 and 5 are configured to collect spitted ink as well as encourage collection of aerosol ("ink mist") from the vicinity of the printhead 100 during printing. Reference will be made below to the first spittoon slot 3 although it will be appreciated that the second spittoon slot 5 has corresponding features.

The first roller 15 is offset from the first row of printhead chips 102, such that a centerline of the printhead chips is downstream of an axis of rotation of the roller. Spitted ink (represented by dashed lines 105) is therefore deposited onto a downwardly sloped upper surface of the first roller 15.

Ink mist ("aerosol") is also generated during printing and may adversely affect print quality. Typically, measures to remove ink mist from a print zone involve vacuum ports above the media feed path, which suck away the mist together with paper dust or other particulates. However, aerosol collectors cannot always be accommodated in the tight space around the printhead and print zone due to electrical and/or ink connections. Dedicated aerosol collectors also add to the overall cost of printers.

As foreshadowed in the present inventor's U.S. Provisional Application No. 62/505,736 filed 12 May 2017, the contents of which are incorporated herein by reference, a surprising improvement in aerosol collection from below the platen was observed when a wick bar (for collecting spitted ink) was appropriately placed in a spittoon slot compared to having no wick bar present in the spittoon slot. The positioning of the wick bar had a beneficial effect on directing airflow and thereby aerosol flow into a gap at one side of the wick bar. The present invention having the first roller 15 positioned within the first spittoon slot 3 and proximal the printhead 100 functions in similar manner to the invention described in 62/505,736, except using a roller/scraper arrangement for removing spitted ink as opposed to a wick bar. Accordingly, the presence of the first roller 15 proximal the printhead 100 assists in directing aerosol into a first downstream gap 40 between the first roller and the dividing wall 11. Within the design constraints of the system, the width of the downstream gap 40 is maximized as far as possible and it will be seen that the first downstream gap 40 is wider than the second upstream gap 42 defined between the second roller 17 and the dividing wall 11. A tapered upper portion of the dividing wall 11 further assists in directing aerosol into the first downstream gap 40. In addition, the rotational direction of the first roller 15 is such that the upper roller surface 19 moves in a same direction as the media feed direction F. Hence, a Couette airflow associated with the first roller 15 encourages aerosol into the first downstream gap 40 and, moreover, does not oppose the Couette airflow associated with the print media fed in the direction F. In some embodiments, the first roller 15 is rotated with sufficient angular velocity to direct aerosol into the first downstream gap 40 without requiring suction from the below the platen 1. In other embodiments, suction may be applied to the first spittoon slot 3 (e.g. via a vacuum blower) to assist with aerosol extraction from the print zone.

It will be appreciated that the second spittoon slot functions in a similar manner to the first spittoon slot 3, albeit with a wider second downstream gap 44 by virtue of less design constraint downstream of the second row 104 of printhead chips. For the sake of brevity, like features and functionality will not be repeated and described separately in respect of the second spittoon slot 5. It will further be appreciated that in FIG. 7 the upstream ribs 21, downstream ribs 23 and intermediate ribs 25 as well as the scrapers 37 have been removed for clarity since they have minimal effect on airflow through the first and second spittoon slots 3 and 5.

In accordance with known maintenance arrangements for pagewide printheads, the platen 1 may be liftable towards and away from the printhead 100 to enable capping and/or maintenance interventions when required, or to clear paper jams. A suitable arrangement for lifting and translating a platen to enable maintenance and/or capping interventions is described in U.S. Pat. No. 8,523,316, the contents of which are incorporated herein by reference. Additionally or alternatively, the printhead 100 may be liftable towards and away from the platen 1. A suitable arrangement for lifting and translating a printhead to enable maintenance and/or capping interventions is described in U.S. Pat. No. 9,061,531, the contents of which are incorporated herein by reference.

From the foregoing and from the experiments described in U.S. Provisional Application No. 62/505,736, it will be appreciated that the platen 1 described herein provides improved collection of spitted ink and, particularly, improved collection of ink mist or aerosol from the vicinity of a printhead compared to prior art arrangements.

It will, of course, be appreciated that the present invention has been described by way of example only and that modifications of detail may be made within the scope of the invention, which is defined in the accompanying claims.

The invention claimed is:

1. A printer comprising:

an inkjet printhead having first and second rows of printhead chips;

a platen having first and second spittoon slots corresponding to the first and second rows of printhead chips, each spittoon slot having a length corresponding to a length of the printhead and a width extending between a respective upstream sidewall and a respective downstream sidewall of the platen;

first and second rollers positioned in the respective first and second spittoon slots for receiving ink spitted from the first and second rows of printhead chips;

a rotation mechanism for rotating the first and second rollers; and first and second scrapers engaged with respective first and second rollers, wherein a diameter of each roller is less than the width of its respective spittoon slot.

2. The printer of claim 1, wherein an upper surface of each roller is less than 3 mm from a nozzle plate of the printhead.

3. The printer of claim 1 wherein each spittoon slot is under suction.

4. The printer of claim 1, wherein a longitudinal axis of each roller is offset from its corresponding row of printhead chips.

5. The printer of claim 4, wherein a centerline of each row of printhead chips is downstream of an axis of rotation of its corresponding roller relative to the media feed direction.

6. The printer of claim 5, wherein the rotation mechanism is configured to rotate either or both rollers such that an upper surface of each roller moves in a same direction as the media feed direction.

7. The printer of claim 6, wherein an upstream gap and a downstream gap are defined at either side of each roller and wherein rotation of each roller directs ink aerosol into the downstream gap by virtue of a proximity of the roller to the platen surface.

8. The printer of claim 1, wherein the upstream gap is wider than the downstream gap or vice versa.

9. The printer of claim 1, wherein the platen comprises a plurality of spaced apart ribs projecting upwards from a platen surface for supporting print media clear of the roller.

10. The printer of claim 1, wherein each of the first and second rows of printhead chips comprises a continuous line of butting printhead chips and each of the first and second spittoon slots has sufficient length to receive ink from respective first and second rows of printhead chips.

11. The printer of claim 10, wherein the platen comprises a dividing wall positioned between the first and second rows of printhead chips, the dividing wall defining a downstream sidewall for the first spittoon slot and an upstream sidewall for the second spittoon slot.

12. The printer of claim 11, wherein a plurality of intermediate ribs project upwardly from the dividing wall for supporting print media between the first and second spittoon slots.

13. The printer of claim 12, wherein each intermediate rib has an upwardly flared profile.

14. The printer of claim 12, wherein an upper surface of each intermediate rib is angled upwards towards a downstream side thereof.

15. The printer of claim 12, wherein the platen further comprises upstream ribs projecting upwardly from the upstream sidewall at the upstream side of the first spittoon slot and downstream ribs projecting upwardly from the downstream sidewall at the downstream side of the second spittoon slot.

16. The printer of claim 15, wherein the upstream ribs, the downstream ribs and the intermediate ribs are all offset from each on the media feed direction.

17. The printer of claim 11, wherein the rotation mechanism is configured to rotate the first and second rollers in a same direction such that an upper surface of each roller moves in a same direction as the media feed direction.

18. The printer of claim 11, wherein the platen further comprises a removable collection tray positioned beneath the first and second spittoon slots.

19. The printer of claim 18, wherein the collection tray receives collected ink from respective scrapers under gravity.

* * * * *